US006715186B1

(12) United States Patent
Huang

(10) Patent No.: US 6,715,186 B1
(45) Date of Patent: Apr. 6, 2004

(54) CHARM CHAIN

(76) Inventor: Pei-Hui Huang, 5F, No. 48, Tien Shui Rd., Taipei (TW)

( * ) Notice: Subject to any disclaimer, the term of this patent is extended or adjusted under 35 U.S.C. 154(b) by 0 days.

(21) Appl. No.: 10/425,912

(22) Filed: Apr. 30, 2003

(51) Int. Cl.[7] ..... A41F 1/00; A44B 21/00; A44C 5/00; A45F 5/04

(52) U.S. Cl. ..... 24/299; 24/3.13; 24/68 J; 24/71 J; 24/116 A; 24/298; 24/302; 2/271

(58) Field of Search ..... 24/299, 298, 302, 24/305, 300, 291, 16 R, 16 A, 3.13, 116 A, 68 J, 69 J, 70 J, 71 J; 2/271

(56) References Cited

U.S. PATENT DOCUMENTS 2,042,808 A * 6/1936 Seebeck ..... 24/3.13
2,350,339 A * 6/1944 Costa ..... 24/298
2,820,269 A * 1/1958 Wolff ..... 24/300
3,328,064 A * 6/1967 Simon ..... 24/298
5,230,451 A * 7/1993 Onozawa ..... 24/3.4
5,313,669 A * 5/1994 Rasdell et al. ..... 24/302
5,615,454 A * 4/1997 Contarino ..... 24/3.13
5,675,841 A * 10/1997 Jackson ..... 24/302
5,852,849 A * 12/1998 Lansing et al. ..... 24/298

* cited by examiner

*Primary Examiner*—Victor Sakran
(74) *Attorney, Agent, or Firm*—Bacon & Thomas, PLLC

(57) ABSTRACT

A charm chain is comprised of an ornamental chain in a selected shape, multiple snaps and a lining band, snaps being respectively fixed to both ends of the ornamental chain and retain the lining band at the bottom of the ornamental chain for the charm chain to be adapted to a string bikini, a bra, a strap or any other accessories for ornamental purpose and safe use since the ornamental chain is prevented from directly contacting one's skin by means of the: lining band.

6 Claims, 8 Drawing Sheets

CHARM CHAIN

BACKGROUND OF THE INVENTION (a) Field of the Invention

The present invention is related to a charm chain, and more particularly, to one attached to lingerie, such as a string bikini, bra, strap, to display innovative and unique ornament of beauty.

(b) Description of the Prior Art

Women nowadays wear brassier not as an underwear, but as an outfit; partially exposure of straps or bra or string bikini is also a fashion. Strapless bra is popular, and if strap is required, a see-through TPU (thermoplastic polyurethane) is used. As TPU is practically invisible, various types of ornamental loops and clips in sparkling colors are attached to the strap. Some bra straps are even forthwith made of chains inlayed with gold, silver, or jewels and they can get as much extravagant. However, when having directly contacted the skin for a longer time, those straps made of gold, silver or other metal could hurt one's skin by corrosion, making them not safe to wear.

SUMMARY OF THE INVENTION

The primary purpose of the present invention is to provide a charm chain that is safe and beautiful to use. To achieve the purpose, the charm chain is comprised of a chain with given shape, multiple snaps, and a lining band to match the chain. Wherein, the chain is inlaid with any ornamental object as desired and has it both ends respectively connected to a snap. Each snap is provided at its both ends an inner and an outer hooks, and inner hooks are used to join the lining band at the bottom of the chain. The chain can be attached to any accessory of the lingerie as appropriately to demonstrate its ornamental effects while the lining band prevents direct contact of the chain against the skin.

Another purpose of the present invention is to provide a charm chain that is made into a Y shape, a flat shape or any other selected shape to be attached to the string bikini, bra, strap and other feminine accessories without restriction to its application.

Another purpose yet of the present invention is to provide a charm chain that is forthwith made into a strap and looped to a snap in "8", shape so that the lining band (the strap) when looped through the "8"-shape snap forms an adjustment hole for adjusting the chain and the lining band (the strap) to facilitate retaining the chain to the lining band, i.e. the strap.

DETAILED DESCRIPTION OF THE PREFERRED EMBODIMENTS

Figure 1:
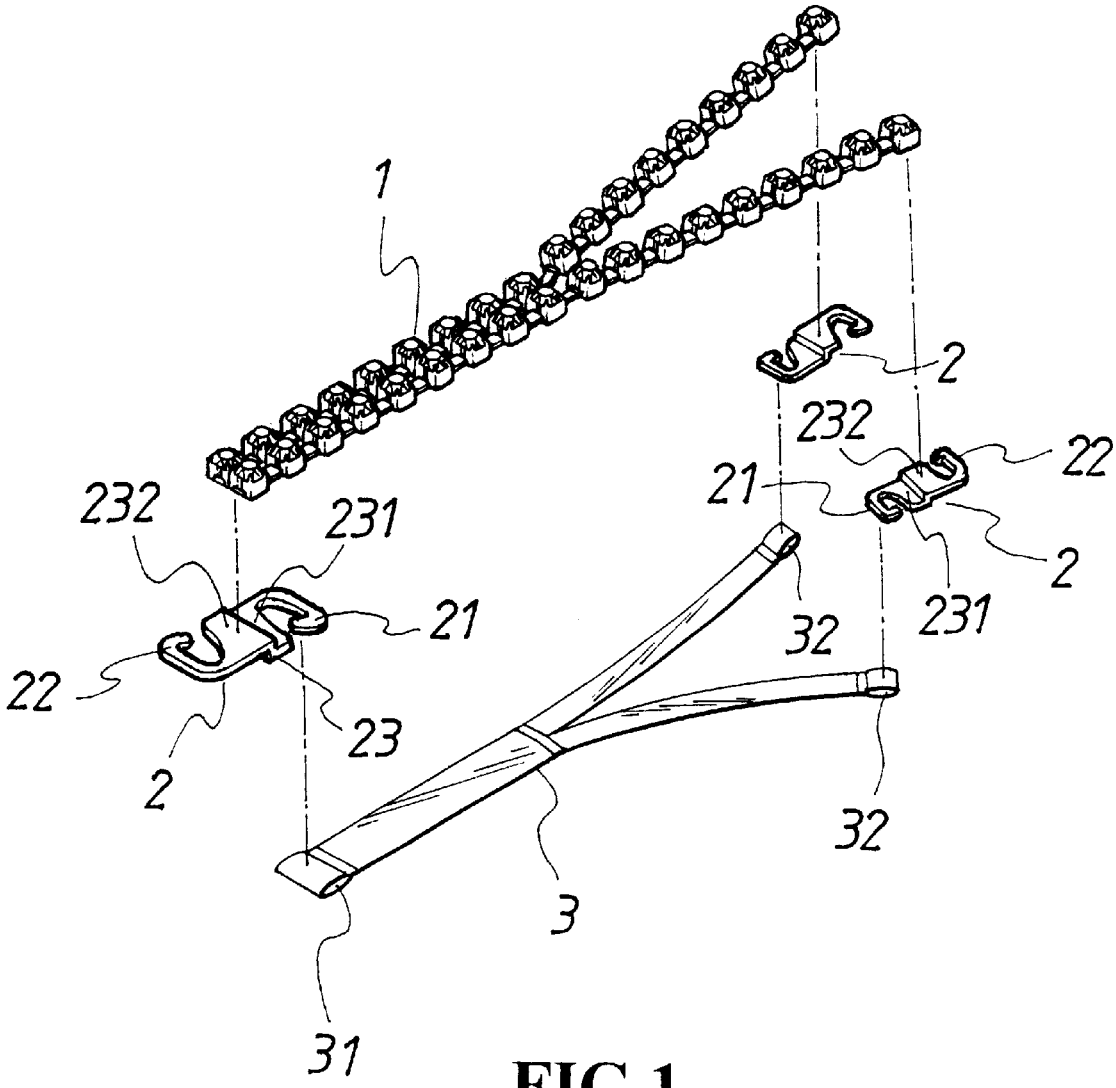
FIG. 1 is an exploded view of a Y-shape charm chain of the present invention.

Referring to FIGS. 1 through 4, a charm chain of the present invention is essentially comprised of a chain 1, multiple snaps 2 and a lining band 3. Wherein, the chain 1 is provided with a given shape, e.g. Y shape or flat shape, and can be inlaid with any type of ornamental object. In the preferred embodiment, the chain 1 relates to one that inlaid with gold, silver or jewels. However, the preferred embodiment does not in any way restrict the type or form of the ornamental object to be inlaid.

Multiple snaps 2 are respectively fixed to the head and tail of the chain 1. Each snap may indicate approximate S shape having at its both ends provided with an inner hook 21 and an outer hook 22, and its middle section 23 to be fixed to the head or the tail of the chain 1 by welding or adhesion. The middle section 23 may be comprised of an upper gradation 232 and a lower gradation 231 so that both of the head and tail of the chain 1 may be respectively fixed to the lower gradation 231 and the inlay of the chain 1 may be provided flush with another upper gradation 232.

The lining band 3 in a shape corresponding to that of the chain 1, is made of material that will not hurt the skin of the wearer of the chain, such as the same TPU used for the see-through strap of a bra. Two loops 31, 32 are respectively provided on both ends of the lining band 3 to join each inner hook 21 of the snap 2 for the lining band 3 to be provided on the bottom of the chain 1.

The charm chain is hooked to a string bikini, a bra, a strap or other accessories of the lingerie to demonstrate its ornamental effects while the lining band 3 being provided between the skin and the chain 1 to prevent the skin from being hurt by corrosive effect of the chain 1.

Figure 2:
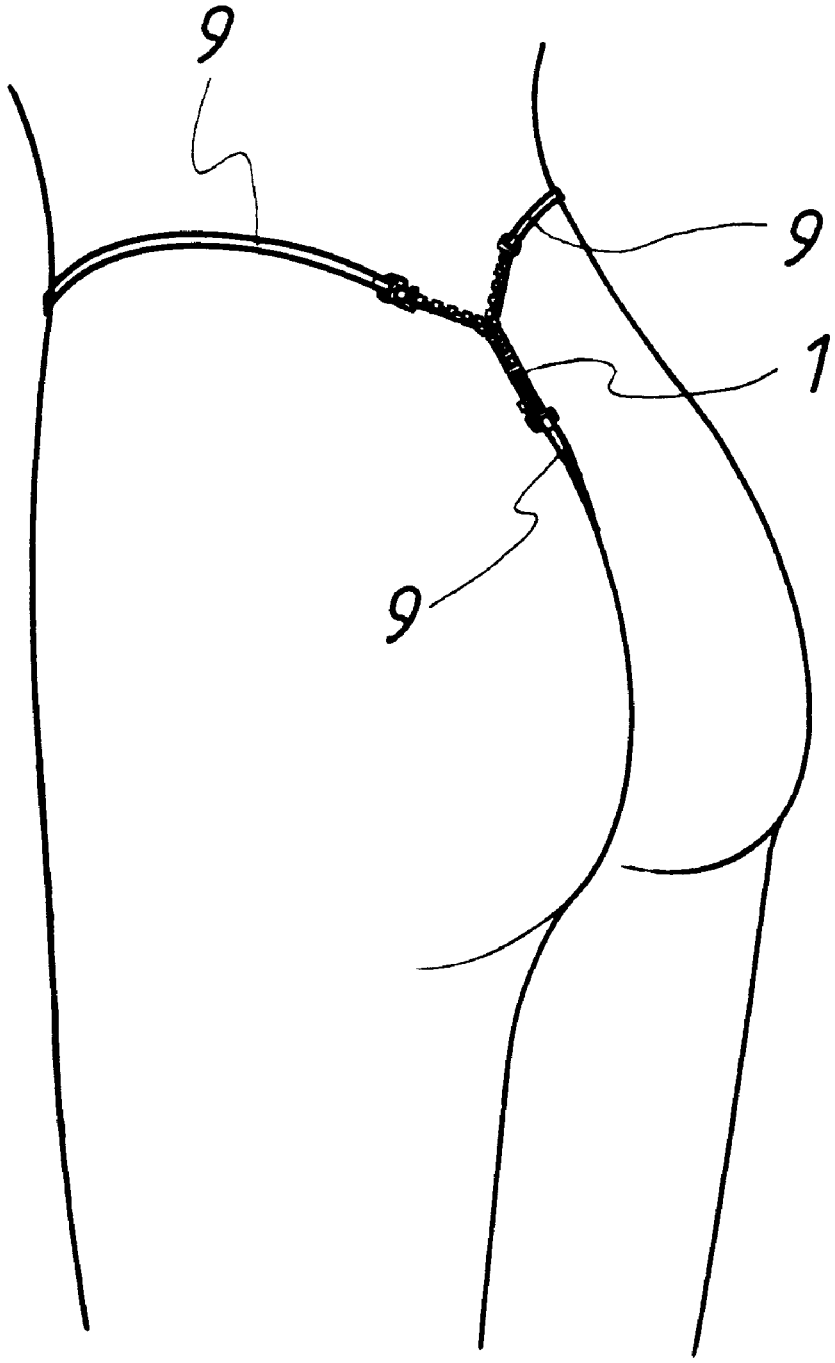
FIG. 2 is a schematic view showing that the Y-shape charm chain of the present invention is adapted to a string bikini.
Figure 3:
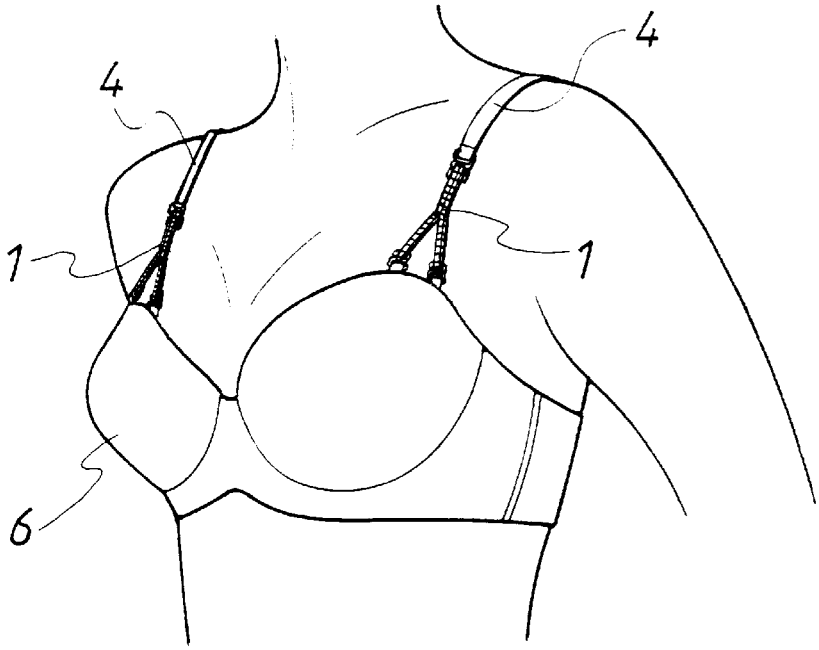
FIG. 3 is a schematic view showing that the Y-shape charm chain of the present invention is adapted to connect a bra and a strap.
Figure 4:
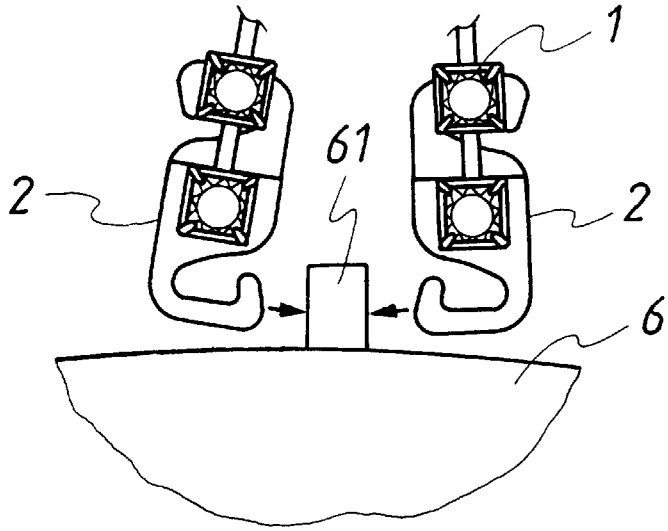
FIG. 4 is a schematic view showing that the Y-shape charm chain of the present invention is adapted to a single buckle of the bra.
Figure 5:
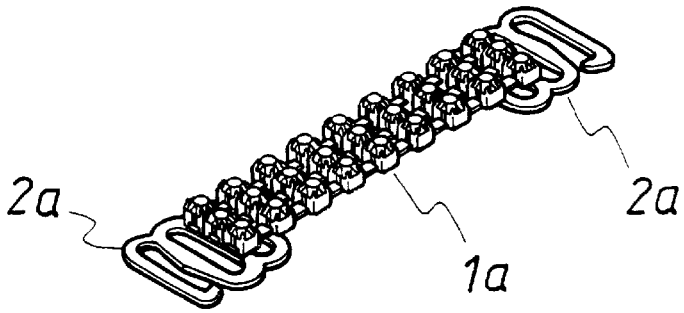
FIG. 5 is a perspective view showing an assembly of another preferred embodiment of the present invention that indicates a flat shape.
Figure 6:
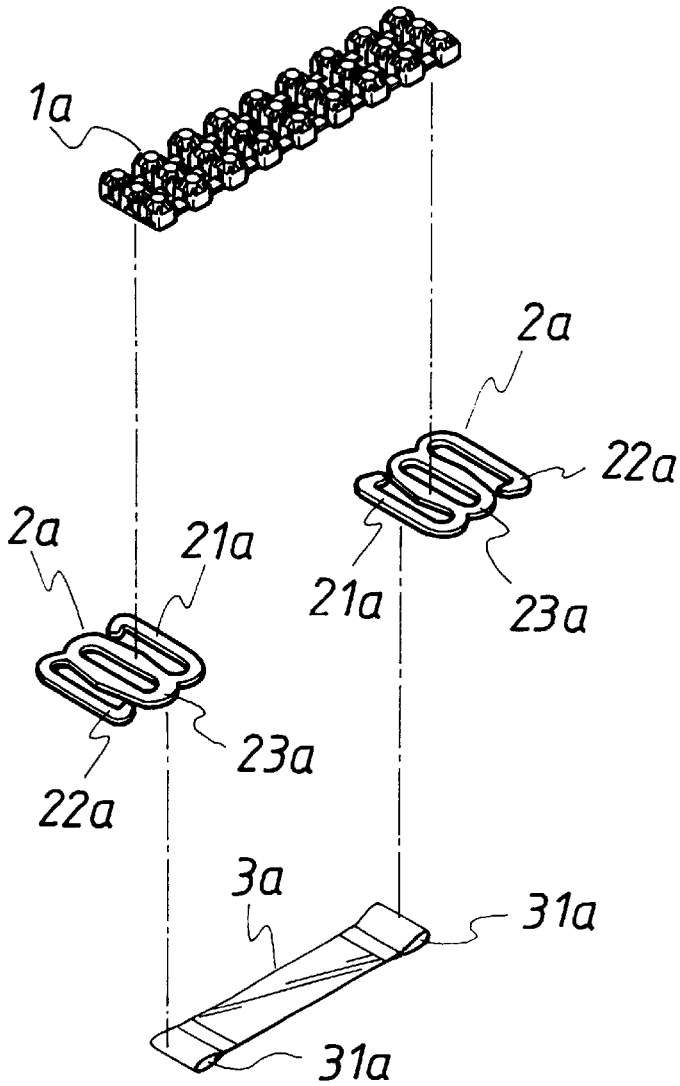
FIG. 6 is an exploded view showing the flat charm chain of the present invention.

The preferred embodiment of the present invention given in FIG. 1 through FIG. 4 relates to a Y shape chain 1. One snap 2 is each fixed to three ends of the Y-shape chain 1, and a lining band 3 also indicating Y shape is provided to the Y-shape chain 1. A loop 31 is provided to the head of the Y-shape lining band 3 and one loop 32 is each provided to both branches of the Y-shape chain 1 to be respectively locked up by an inner hook 21 of a snap 2 for the lining band 3 to be attached to the bottom of the Y-shape chain 1 to form a Y-shape charm chain. The Y-shape charm chain is connected to a string 9 of a string bikini as illustrated in FIG. 2, or is connected between a strap 4 and a bra 6 as illustrated in FIG. 3, or both braches of the Y-shape charm chain are connected to a single buckle 61 of a bra 6 as illustrated in FIG. 4.

Figure 8:
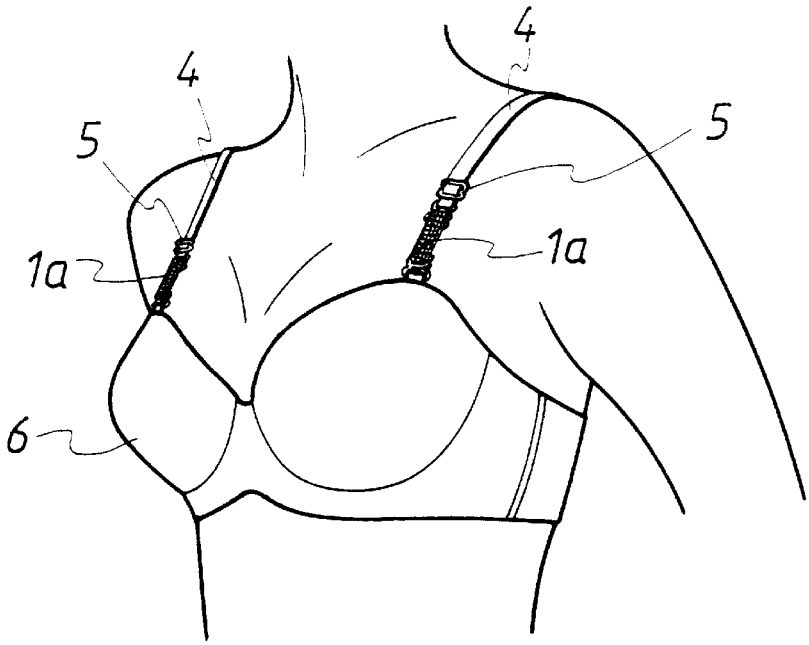
FIG. 8 is a view showing that the flat charm chain of the present invention is adapted to an "8" shape snap to function as a strap to the bra.
Figure 7:
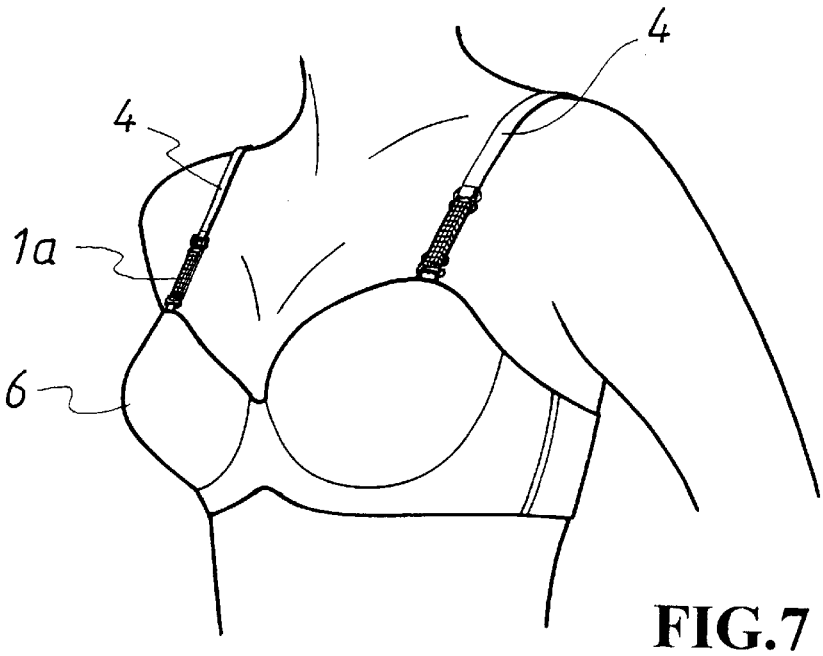
FIG. 7 is a schematic view showing that the flat charm chain is used to connect a bra and its strap.
Figure 9:
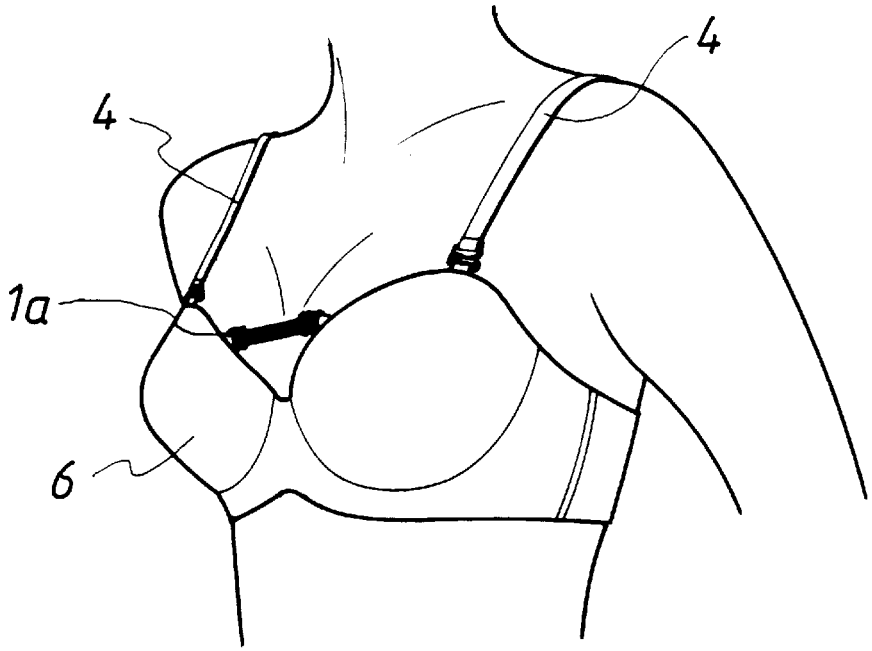
FIG. 9 is a schematic view showing that the flat charm chain is adapted to connect both bra cups.

FIG. 6 through FIG. 10 show another preferred embodiment of the present invention that is related to a flat type of a chain la having at its both ends fixed to a snap 2*a*, and at its bottom a flat lining band 3*a*. The snap 2*a* may be provided in an "S" shape with both ends provided with an inner hook 21*a* and an outer hook 22*a* while its middle section 23*a* being respectively fixed to both ends of the chain 1*a*. Loops 31*a*, 32*a* are respectively provided to both ends of the lining band 3*a* to be each buckled to the inner hooker 21*a* of the snap 2*a* for the lining band 3*a* to be provided at the bottom of the chain 1*a* to form a flat charm chain for connecting a strap 4 and a bra 6 as illustrated in FIG. 7, or being adapted to an "8"-shape snap 5 of a strap 4 as illustrated in FIG. 8, or abridging both cups of a bra 6 for ornamental purpose as illustrated in FIG. 9. It is to be noted that all the preferred embodiments of the present invention adapted to a bra are given for description purpose and certainly in no way for restricting their uses in lingerie other than the bra or strap.

Figure 10:
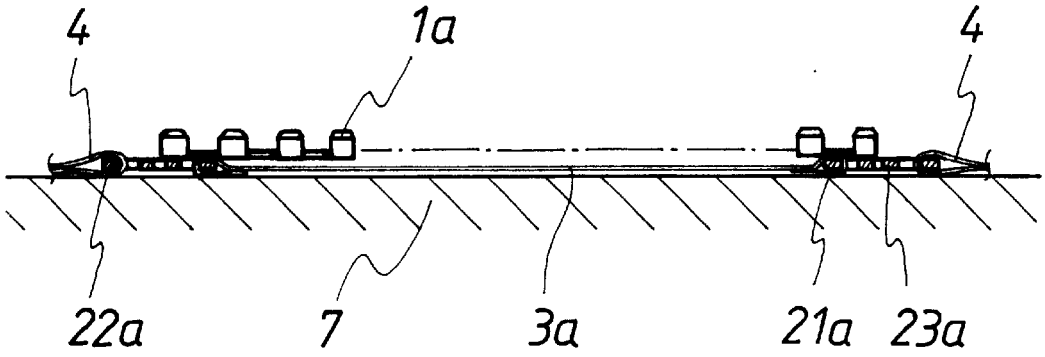
FIG. 10 is a sectional view showing the flat charm chain of the present invention.

Now referring to FIG. 10, the chain 1*a* is separated from direct contact of one's skin 7 by the lining band 3*a* to protect the skin 7 from possible corrosion by the chain 1*a*.

Figure 13:
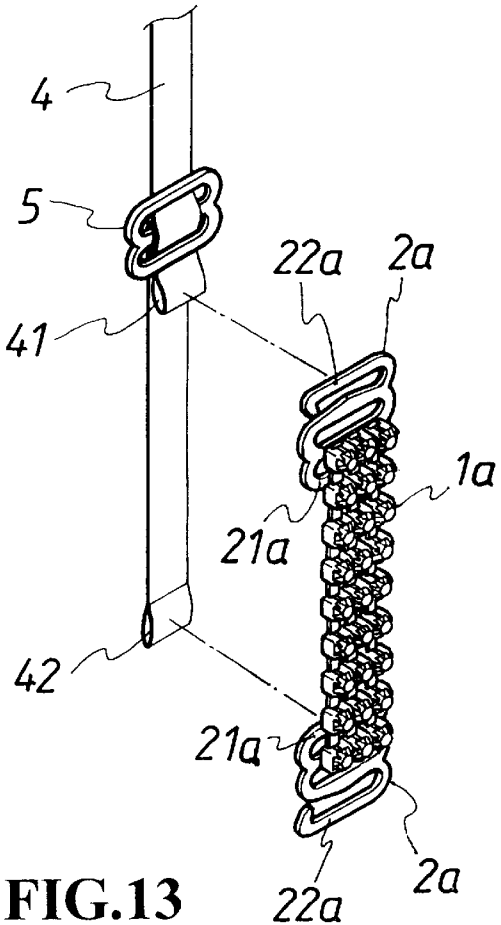
FIGS. 11, 12 and 13 show a series motions of having the flat charm chain adapted to an "8" shape snap that incorporates the charm chain to a strap.
Figure 12:
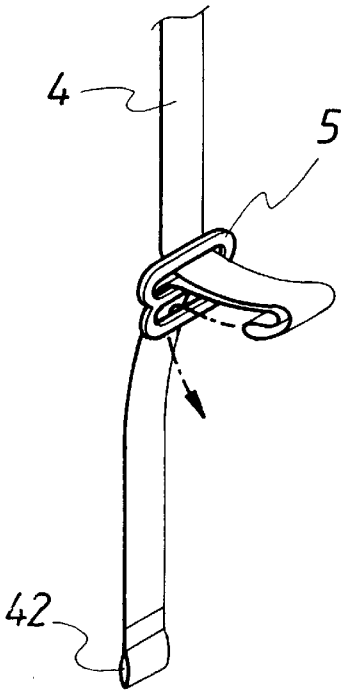
Figure 11:
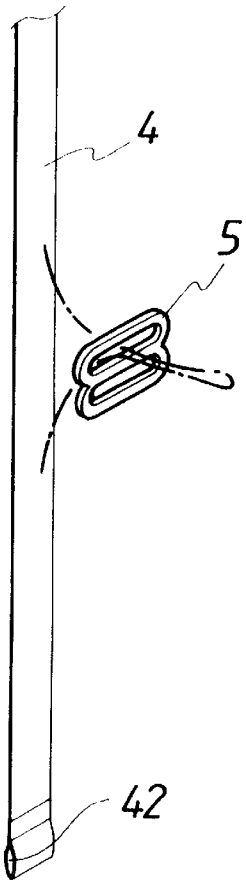

As illustrated in FIGS. 11, 12 and 13, the present invention is adjustable when incorporated with a strap 4 by means of an "8"-shape snap 5. Wherein, a selected section of the strap 4 is folded into one of both loops of the "8"-shape snap 5 as illustrated in FIG. 12, then through another loop as illustrated in FIG. 13 for the strap 4 to merely form an adjustment loop 41 for the charm chain of the present invention to respectively buckled to the adjustment loop 41 and the terminal loop 42.

Figure 14:
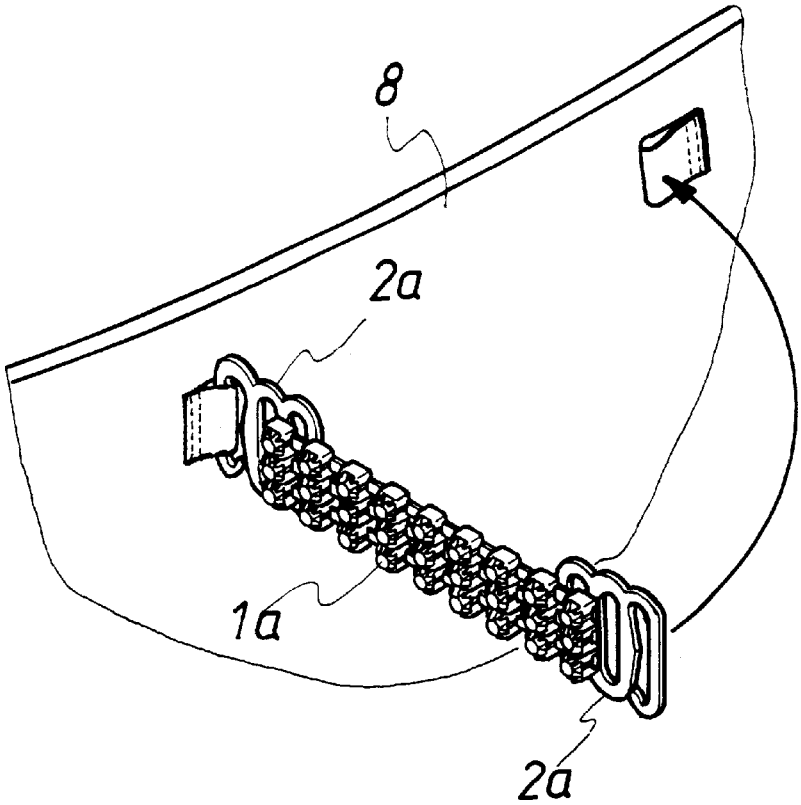
FIG. 14 is a schematic view showing that the flat charm chain is attached to a top band of underwear.
Figure 15:
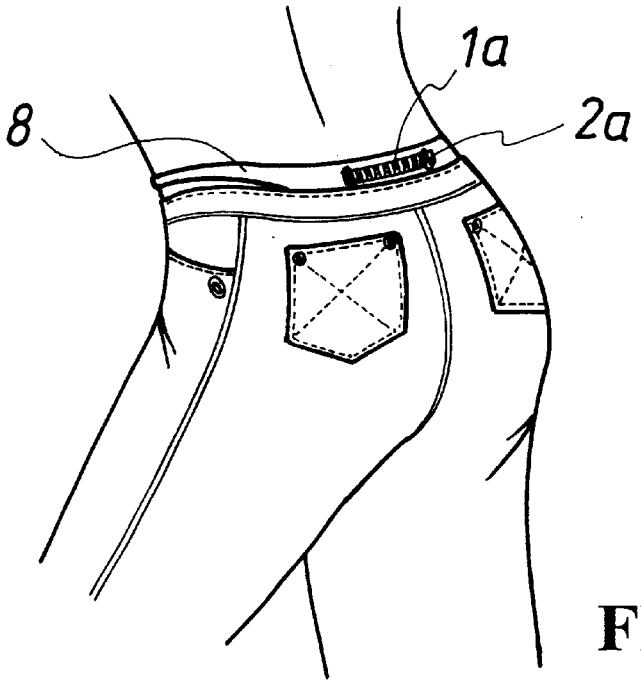
FIG. 15 is a schematic view showing that the flat charm chain is attached to a top band of underwear exposed out of a jean.

Preferred embodiments as illustrated are only showing examples of the present invention and not restricting the technical scope of the present invention. It should be noted that any summary change or replacement based on the art of the present invention or any equivalent application shall fall within the technical scope of the present invention. The present invention does not limit its use on a string bikini, bra or a strap it may also be adapted to a tight 8 with band to be exposed as illustrated in FIGS. 14 and 15.

What is claimed is:

1. A charm chain is comprised of an ornamental chain in a selected shape, multiple snaps and a lining band characterized by that:

The ornamental chain in a given shape and comprised of inlaid ornament;

multiple snaps being each fixed to both ends of the ornamental chain, an inner hook and an outer hook being provided on both ends of the snap, and the middle section of the snap being fixed to both ends of the ornamental chain; and the lining band, provided at the bottom of the ornamental chain, made of material not hurting one's skin, and in a shape corresponding to that of the ornamental chain, a loop being each provided to both ends to be respectively buckled by the inner hook of the snap;

when assembly to form a charm chain to be adapted to a string bikini, a bra, a strap or any other accessories, to become more attractive and safe to use since the lining band prevents direct contact of the skin by the ornamental chain.

2. A charm chain as claimed in claim 1, wherein, both of the chain and the lining band are made in the same Y shape.

3. A charm chain as claimed in claim 1, wherein, both of the chain and the lining band are made in the same flat shape.

4. A charm chain as claimed in claim 1, wherein, the charm chain is attached to a see-through strap by means of an "8" snap; wherein, a selected portion of the strap being folded to pass through one loop of the "8"-shape snap, then into another loop for the strap to from an adjustment loop with the charm chain respectively buckled to the adjustment loop and its terminal loop.

5. A charm chain as claimed in claim 1, wherein, the snap indicates an "S" shape.

6. A charm chain as claimed in claim 1, wherein, the middle section of the snap is provided with a lower gradation and an upper gradation so that both ends of the chain being fixed to the lower gradation and the inlay of the chain to be flushed with the upper gradation.

* * * * *